US012510291B2

(12) United States Patent
Cöp et al.

(10) Patent No.: US 12,510,291 B2
(45) Date of Patent: Dec. 30, 2025

(54) HOUSEHOLD APPLIANCE INCLUDING A BODY HAVING A COMPONENT HOUSING

(71) Applicant: BSH Hausgeräte GmbH, Munich (DE)

(72) Inventors: Burak Cöp, Tekirdag (TR); Dogan Kilinc, Istanbul (TR); Eser Velisan, Muratli (TR); Hüseyin Ergüden, Tekirdag (TR)

(73) Assignee: BSH Hausgeräte GmbH, Munich (DE)

( * ) Notice: Subject to any disclaimer, the term of this patent is extended or adjusted under 35 U.S.C. 154(b) by 109 days.

(21) Appl. No.: 18/507,274

(22) Filed: Nov. 13, 2023

(65) Prior Publication Data

US 2024/0159458 A1 May 16, 2024

(30) Foreign Application Priority Data

Nov. 10, 2022 (TR) ..... 2022/017042

(51) Int. Cl.
*F25D 11/00* (2006.01)
*F25D 23/06* (2006.01)

(52) U.S. Cl.
CPC ..... *F25D 23/065* (2013.01)

(58) Field of Classification Search
CPC ..... F25D 23/065; F25D 29/005; F25D 23/006
See application file for complete search history.

(56) References Cited

U.S. PATENT DOCUMENTS

| | | | | |
|---|---|---|---|---|
| 2014/0216098 | A1* | 8/2014 | Heinrich | F25D 23/006 62/448 |
| 2019/0178561 | A1* | 6/2019 | Marinello | F28D 1/0477 |

FOREIGN PATENT DOCUMENTS

| | | | |
|---|---|---|---|
| CN | 114174745 | A | 3/2022 |
| EP | 3757484 | A1 | 12/2020 |
| JP | H03282181 | A | 12/1991 |
| JP | 2022146443 | A | 10/2022 |

* cited by examiner

*Primary Examiner* — Amy J. Sterling
(74) *Attorney, Agent, or Firm* — Laurence A. Greenberg; Werner H. Stemer; Ralph E. Locher

(57) ABSTRACT

A household appliance, particularly a cooling appliance, includes a body with an outer wall facing outside and an inner wall spaced apart from the outer wall. One or more system components are located between the walls. An external component housing, which is disposed inside the body, has an access opening for reaching at least a portion of the respective system components from outside.

15 Claims, 9 Drawing Sheets

HOUSEHOLD APPLIANCE INCLUDING A BODY HAVING A COMPONENT HOUSING

CROSS-REFERENCE TO RELATED APPLICATION

This application claims the priority, under 35 U.S.C. § 119, of Turkish Patent Application TR 2022/017042, filed Nov. 10, 2022; the prior application is herewith incorporated by reference in its entirety.

FIELD AND BACKGROUND OF THE INVENTION

The present invention relates to a household appliance, particularly a cooling appliance, including a body with an outer wall facing outside, an inner wall spaced apart from the outer wall, and one or more system components located between the walls.

DESCRIPTION OF THE RELATED ART

Household appliances, in particular cooling appliances, include various components such as electrical components or system components such as cooling system components. Those components can have complex assemblies and connections. Therefore, during the mounting process of the appliances or in any maintenance operation, reaching the components is not as easy as possible.

European Patent Application EP3757484A1 discloses a refrigerator appliance including an evaporator that, together with a compressor and a condenser, forms a closed cooling circuit wherein a refrigerant fluid is made to circulate. The condenser is configured as a skin condenser and includes a serpentine tube associated with a thermally conductive layer. The thermally conductive layer is made up of a plurality of plates disposed in such a way that a tail portion of a first plate is superimposed to and connected with a front portion of a second plate. Straight portions of the serpentine tube are clinched between the two plates at their connection interface. A defrost water drainpipe, typically used to drain condensation water from the evaporator, is disposed in thermal exchange contact with the skin condenser.

The present invention provides an additional improvement, an additional advantage or an alternative to the prior art.

SUMMARY OF THE INVENTION

It is accordingly an object of the invention to provide a household appliance, particularly a cooling appliance, including a body having a component housing, which overcomes the hereinafore-mentioned disadvantages of the heretofore-known appliances of this general type and which has system components that are easy-to-reach whenever there is a need for access.

With the foregoing and other objects in view there is provided, in accordance with the invention, a household appliance, particularly a cooling appliance, comprising a body with an outer wall facing outside, an inner wall spaced apart from the outer wall, and one or more system components located between the walls.

The household appliance further includes an external component housing which is provided inside the body and has an access opening for reaching at least a portion of the respective system components from outside.

Thus, at least a portion of the system components can easily be accessed from outside and the mounting process or maintenance operation can be done more quickly and easily. Moreover, the labor costs of the mounting process of the household appliance are reduced.

Here, the system components can be any kind of cooling or electrical system components.

The cooling system components can be pipes or tubes through which a hot fluid, cold fluid or a gas passes.

The electrical system components can be the electrical cables of the electrical components.

In a possible embodiment of the invention, the component housing is disposed as a box-shaped structure.

Thus, both at least a portion of the system components can easily be accessed from outside, and the portion of the system component inside the component housing is prevented from being exposed to an insulation material provided between the inner wall and the outer wall.

The component housing may have a rear wall in the sense of a bottom wall. Further, the component housing may have side walls, e.g. four side walls, which may reach up from the bottom wall.

In a possible embodiment of the invention, an access cutout is configured on the outer wall so to correspond to the access opening.

Thus, at least a portion of the system components can easily be accessed from outside and the mounting process or maintenance operation can be done more quickly and easily.

In a possible embodiment of the invention, the component housing includes a connection frame which is substantially parallel to the outer wall.

Thus, the external component housing connects to the outer wall. Here, the connection frame can be connected to the outer wall via a kind of connection element such as a screw, or an adhesive element such as a kind of double-sided tape.

In a possible embodiment of the invention, the connection frame includes one or more connection holes for connecting the component housing to the outer wall.

Thus, the connection frame connects to the outer wall via a kind of connection element such as a screw.

In a possible embodiment of the invention, the component housing includes one or more system component fixation devices for fixing the respective system components on a rear wall of the component housing which is opposite to the access opening.

Thus, the system components become stable inside the component housing. Therefore, possible undesirable movements of the system components are prevented.

In a possible embodiment of the invention, the system components are conduits, in particular pipes, through which a fluid passes, and each of the system component fixation devices are shaped and sized with respect to the respective system components so as to at least partially encircle the respective system components in a tight-fit manner.

Thus, the conduits of a cooling system securely connect to the component housing.

Here, the pipes can be pipes of the skin condenser or pipes of the frame heater of the cooling appliance. Such kinds of pipes can be used on the cooling appliance e.g. for preventing condensation on the walls of the body and for easily opening the doors.

Here, any kind of fluid or gas, particularly a coolant or a heating fluid, can pass through the conduits, in particular pipes/tubes.

Here, the pipes/tubes can be the pipes/tubes of a condenser such as a skin condenser or a heater, such as a frame heater.

In particular, the household appliance can include two system components or three system components or four system components. By placing one or more system components at least partially within the external component housing, access to the one or more system components can be easily achieved. In particular, when there are two, three, four or more system components, the assembly or maintenance of the household appliance can be simplified, since access at one distinct area for these system components is achieved.

In a possible embodiment of the invention, two system components each having an end portion are joined or connected to each other within the component housing at their respective end portions. Leading the end portions of two system components into the component housing improves the assembly and maintenance of the household appliance, since the process of joining them can be done conveniently. The two system components may enter the component housing via two opposing walls of the component housing (e.g. two opposing side walls). In particular, all system components may enter the component housing on the very same two opposing walls. In that case, conduits acting as system components can be parallel or at least substantially parallel to each other. In the case that the system components are conduits of a cooling cycle (e.g. pipes of a frame heater, pipes of a skin condenser, etc.) the end portions of two system components can be joined by using glue or can be welded to each other or can be joined to each other using a locking ring process. The locking ring process includes an additional locking ring which is in turn connected (e.g. using glue or welding) to each end of the two conduits.

In a possible embodiment of the invention, one or more cutouts are disposed on side walls of the component housing where the respective conduits enter into the component housing, and one or more sealing members are provided in the respective cutouts so as to surround the respective conduits.

Thus, the regions of the component housing where the conduits enter the conduit housing are sealed with respect to the body, e.g. sealed with respect to an insulation cavity of the body filled with thermal insulation material (e.g. polyurethane foam). Therefore, the inner side or interior of the component housing is prevented from being exposed to the insulation material of the body provided between the inner wall and the outer wall.

In a possible embodiment of the invention, an external cover element is provided so as to be attached to the component housing in a detachable manner for selectively covering the access opening.

Thus, the system components located inside the component housing cannot be seen from outside. In other words, the access opening is aesthetically covered.

In a possible embodiment of the invention, one or more attachment devices are provided on the cover element so as to be attached to the corresponding attachment grooves of the component housing.

Thus, the cover element can be detachably connected to the component housing.

In a possible embodiment of the invention, the cover element includes one or more support devices which abut the rear wall of the component housing, when the cover element is attached to the component housing.

Thus, the rear wall of the component housing is being supported against the pressure of the insulation material of the body. Therefore, due to the pressure applied by the insulation material to the rear wall of the component housing, possible deformations of the rear wall of the component housing are prevented.

In a possible embodiment of the invention, each of the upper attachment devices have a flexible arm defining a detaching surface for detaching the respective upper attachment devices from the corresponding upper attachment grooves by applying an external force. Thus, the cover element can be detached from the component housing in an easy manner.

In a possible embodiment of the invention, the system components are the electrical system components, in particular the electrical cables.

Thus, at least a portion of the electrical system components can easily be accessed from outside and the mounting process or maintenance operation can be done more quickly and easily.

In a possible embodiment of the invention, the component housing is provided at a rear side of the household appliance which is opposite to a front side where at least one door is provided.

Thus, the component housing is disposed at the rear side which faces away from the visible front side of the household appliance. Therefore, the component housing arrangement does not adversely affect the aesthetic appearance of the household appliance.

In a possible embodiment of the invention, the component housing is provided at an approximately middle region of the household appliance between the mutual sidewalls of the body.

Thus, the tubes/pipes of the system that can have a layout at the opposite sides of the appliance can be connected to each other in the most convenient region of the appliance.

Here, the component housing arrangement can be provided at an approximately lower middle region of the household appliance which is closer to the ground whereon the household appliance stands, or at an approximately upper middle region of the household appliance which faces away from the ground.

Here, the wording "middle region" means the region of the household appliance that faces away from both of the sidewalls of the body.

In a possible embodiment of the invention, the component housing may be embedded into an insulation cavity of the body, whereas the insulation cavity is bounded by outer walls of the body and an inner liner which delimits a storage compartment. In particular, a bottom wall or rear wall as well as the side walls of the component housing, may delimit the interior of the component housing from the insulation cavity.

In this context, the indications "top," "bottom," "front," "rear," "horizontal," "vertical," "upward," "downward," "inner," "outer," "inward," "outward," etc. are positions and orientations given for intended use and intended arrangement of the household appliance and for a user standing in front of the household appliance when in a closed position and viewing in the direction of the appliance.

Each possible embodiment disclosed in this text can be combined with the other possible embodiments disclosed in this text if there is not any technical constraint.

Other features which are considered as characteristic for the invention are set forth in the appended claims.

Although the invention is illustrated and described herein as embodied in a household appliance including a body having a component housing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In this detailed description, the subject matter is explained with references to examples without forming any restrictive effect only in order to make the subject more understandable.

Figure 1:
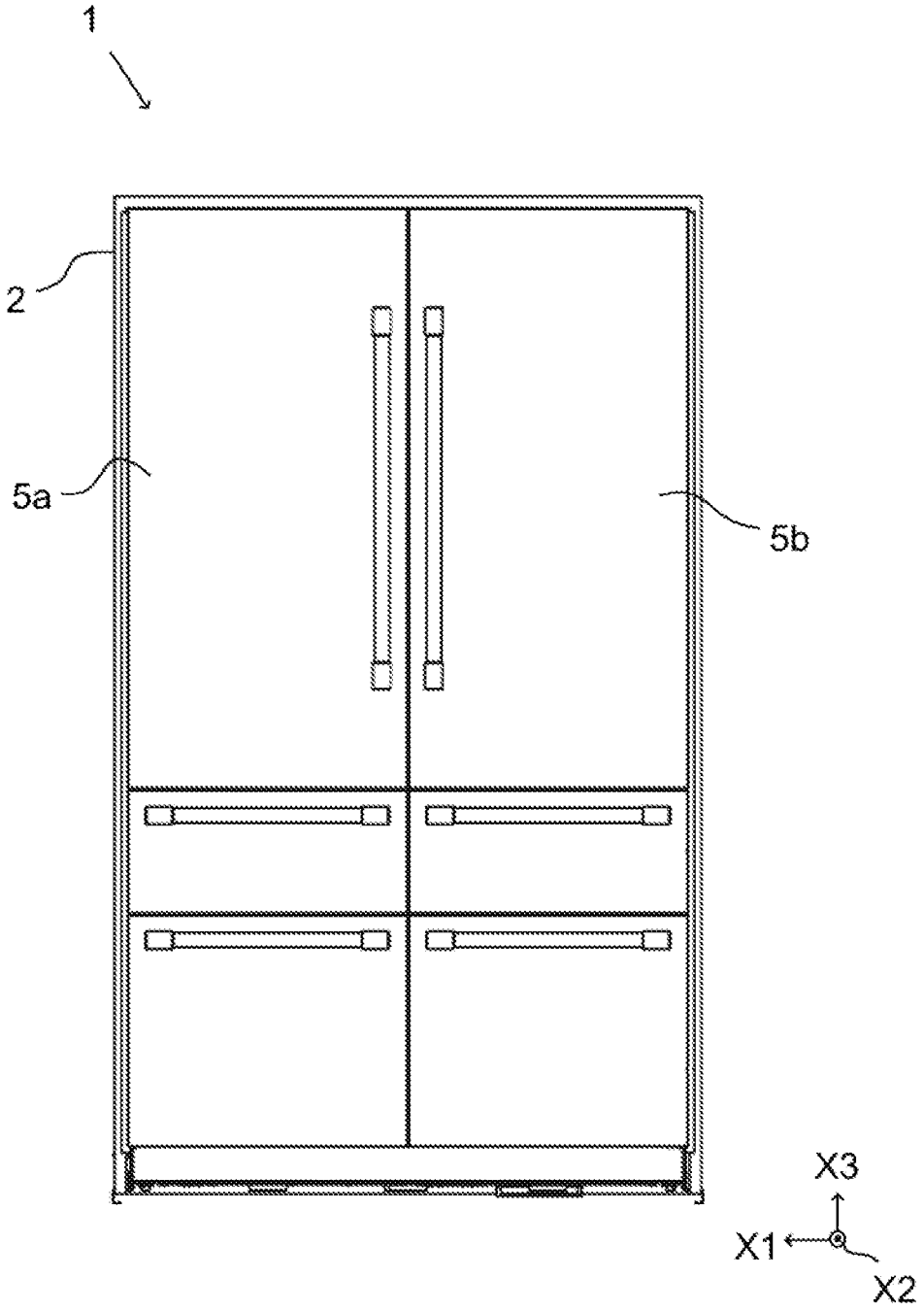
FIG. 1 is a diagrammatic, front-elevational view of an exemplary household appliance.
Figure 2:
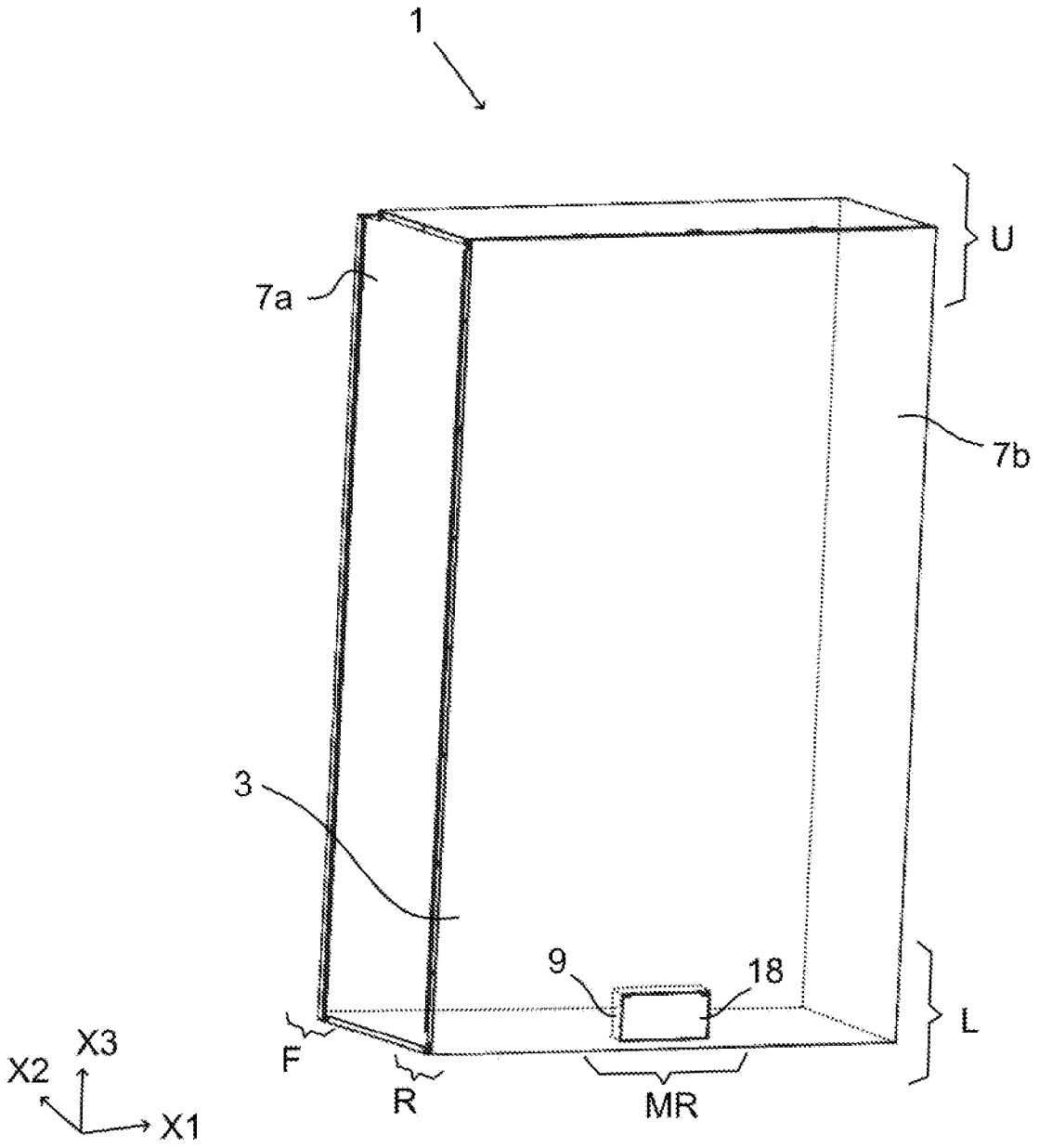
FIG. 2 is a perspective view of the exemplary household appliance from the rear side where the component housing and the cover element are provided at the lower side of the body.
Figure 3:
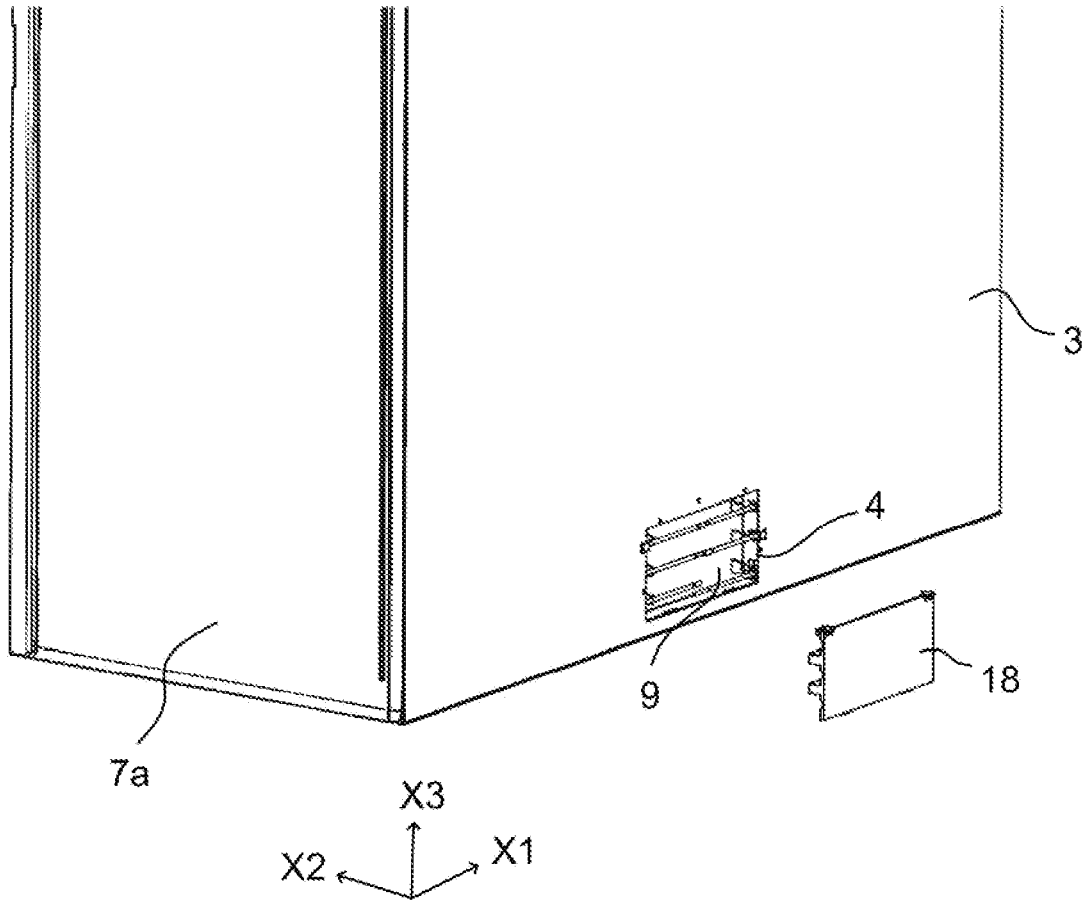
FIG. 3 is a fragmentary, enlarged, exploded perspective view of the household appliance from the rear side where the component housing and the cover element are provided.

Referring now to the figures of the drawings in detail and first, particularly, to FIG. 1 thereof, there is seen a household appliance 1, particularly a cooling appliance, including a body 2 which surrounds a storage compartment that is not shown. The body 2 is provided with an outer wall 3 facing outside, and an inner wall 6 spaced apart from the outer wall 3. The household appliance 1 extends in a length direction X1, width direction X2 and height direction X3. At least one door 5*a*, 5*b* is hinged to the body 2 for delimiting the storage compartment. As can be seen in FIG. 1, the exemplary household appliance 1 includes a first door 5*a* provided on the left side and a second door 5*b* provided on the right side. The doors 5*a*, 5*b* are provided at a front side F of the household appliance 1. As can be seen in FIG. 2, the body 2 has two mutual side walls 7*a*, 7*b* spaced apart each other in the length direction X1. The first sidewall 7*a* of the body is lying in a substantially parallel plane to the second sidewall 7*b* of the body. The walls substantially extend in the width direction X2 and height direction X3 of the household appliance 1. The outer wall 3 is provided at the rear side R of the household appliance 1 which is the side opposite to the front side F. The outer wall 3 is an outer rear wall of the body 2. The outer rear wall substantially extends in the length direction X1 and height direction X3 of the household appliance 1. The household appliance 1 stands on the ground and a side of the body 2 that is closer to the ground is a lower side L of the household appliance 1. Similarly, a side of the body 2 that is away from the ground is an upper side U of the household appliance 1. As can be seen in FIG. 2, there is an external component housing 9 provided inside the body 2. In a possible embodiment, the component housing 9 is located at a rear side R of the household appliance 1 which is opposite to the front side F of the household appliance 1. As shown in FIG. 3, an external cover element 18 is provided so as to be attached to the component housing 9. In a possible embodiment of the invention, the component housing 9 is provided approximately at a middle region MR of the household appliance 1 between the mutual sidewalls 7*a*, 7*b* of the body 2.

Figure 4:
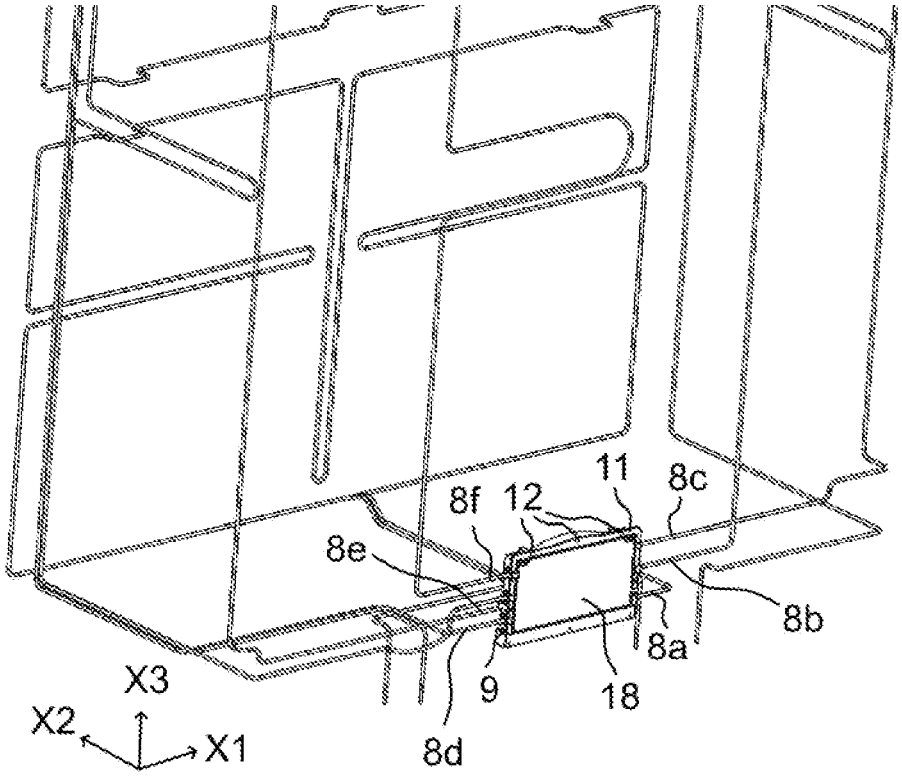
FIG. 4 is a fragmentary, perspective view of the household appliance from the rear side, which shows the component housing, the cover element and the system components.
Figure 5:
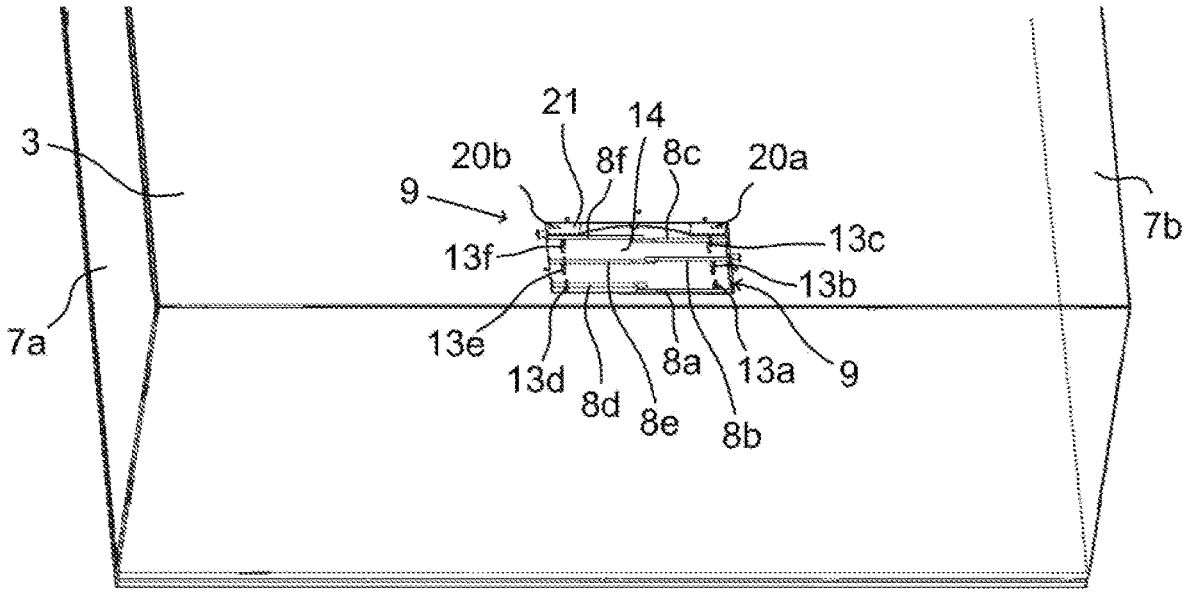
FIG. 5 is a fragmentary, further enlarged, perspective view of the lower side of the household appliance where the component housing and the cover element are provided.
Figure 6:
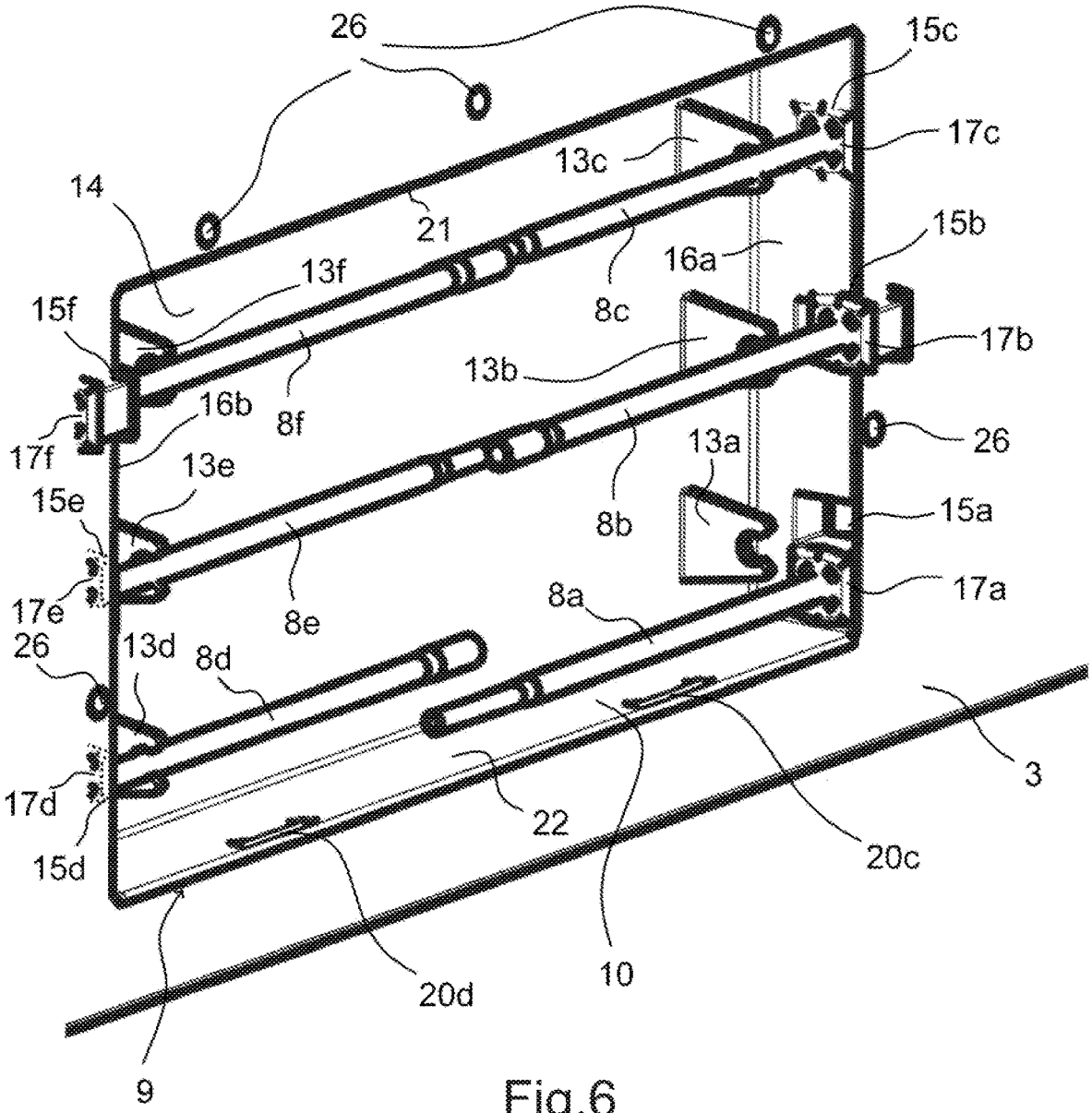
FIG. 6 is a perspective view of the household appliance where the component housing is provided.

With reference to FIG. 4, one or more system components 8*a*-8*f* are located between the inner wall 6 and the outer wall 3. As can be seen in FIGS. 3-6, in a possible embodiment, the system components 8*a*-8*f* are conduits, in particular pipes through which a fluid passes. The pipes can have any kind of cross-section, e.g. circular cross-section. The component housing 9 is an external part. Therefore, the component housing 9 includes a connection frame 11 which is substantially parallel to the outer wall 3 of the body 2. The connection frame 11 includes one or more connection holes of the connection frame 12 for connecting the component housing 9 to the outer wall 3. In a possible embodiment, the component housing 9 is configured as a box-shaped structure. The box-shaped structured component housing has an open side for accessing inside the component housing 9 from outside. The connection frame 11 can be provided at least at one edge of the component housing 9. A connection member which is not shown, such as a screw or a bolt, can pass through respective connection holes 12 of the connection frame 11 and be attached to respective connection holes 26 of an outer wall seen in FIG. 6. As can be seen in FIG. 3, an access cutout 4 is configured on a region of the outer wall 3 where the component housing 9 is located. As can be seen in FIG. 6, the box-shaped structured component housing 9 has an access opening 10 which corresponds to the access cutout 4. The access opening 10 is provided for reaching at least a portion of the respective system components 8*a*-8*f* from outside. In the component housing 9, end portions of each system components 8*a*-8*f*, e.g. end portions of the conduits, are provided. As can be seen FIG. 6, as an example, three system components enter inside the component housing 9 from a left side of the component housing 9, and correspondingly three system components enter inside the component housing 9 from a right side of the component housing 9. In detail, the first system component 8*a* corresponds to the fourth system component 8*d* inside the component housing 9, the second system component 8*b* corresponds to the fifth system component 8*e* inside the component housing 9, and the third system component 8*c* corresponds to the sixth system component 8*f* inside the component housing 9.

In a possible embodiment of the invention, the component housing 9 includes one or more system component fixation devices 13*a*-13*f* for fixing the respective system components 8*a*-8*f*. In more detail, the first system component fixation device 13*a* is provided for fixing the first system component 8*a*, the second system component fixation device 13*b* is provided for fixing the second system component 8*b*, the third system component fixation devices 13*c* is provided for fixing the third system component 8*c*, the fourth system component fixation device 13*d* is provided for fixing the fourth system component 8*d*, the fifth system component fixation device 13*e* is provided for fixing the fifth system component 8*e*, and the sixth system component fixation devices 13*f* is provided for fixing the sixth system component 8*f*. The system component fixation devices 13*a*-13*f* are disposed on a rear wall 14 of the component housing which is opposite to the access opening 10. In a possible embodiment, each of the system component fixation devices 13*a*-13*f* are shaped and sized with respect to the respective system components 8*a*-8*f* so as to at least partially encircle the respective system components 8*a*-8*f* in a tight-fit manner. The system component fixation devices 13*a*-13*f* are configured as a protrusion having a receiving section so as to at least partially encircle the respective system components 8*a*-8*f* in a tight-fit manner. Preferably, each of the system components have a substantially circular cross-section and receiving sections of each of the system component fixation devices 13*a*-13*f* have a substantially C-shape.

As shown in FIG. 6, one or more cutouts 15*a*-15*f* are formed in the sidewalls 16*a*, 16*b* of the component housing 9 where the respective conduits enter inside the component housing 9. Preferably, three cutouts are provided in the first sidewall 16*a* and three cutouts are provided in the second sidewall 16*b*. One or more sealing members 17*a*-17*f* are provided in the respective cutouts 15*a*-15*f* so as to surround the respective conduits. The sealing members 17*a*-17*f* can be made from any kind of rubber material or foam material. In more detail, the first sealing member 17*a* is provided in the first cutout 15*a* and the first system component 8*a* passes through the first sealing member 17*a*, the second sealing member 17*b* is provided in the second cutout 15*b* and the second system component 8*b* passes through the second sealing member 17*b*, the third sealing member 17*c* is provided in the third cutout 15*c* and the third system component 8*c* passes through the third sealing member 17*c*, the fourth sealing member 17*d* is provided in the fourth cutout 15*d* and the fourth system component 8*d* passes through the fourth sealing member 17*d*, the fifth sealing member 17*e* is provided in the fifth cutout 15*e* and the fifth system component 8*e* passes through the fifth sealing member 17*e*, and the sixth sealing member 17*f* is provided in the sixth cutout 15*f* and the sixth system component 8*f* passes through the sixth sealing member 17*f*. There is an insulation material which is not shown and is provided between the inner wall 6 and the outer wall 3 of the body 2 seen in FIG. 8. With such an arrangement, leakage of the insulation material, such as a polyurethane from body 2 to inside the component housing 9, is prevented. Thus, the inside of the component housing 9 is completely isolated from the body 2. In the assembly process of the household appliance 1, the respective end portions of the system components 8*a*-8*f* connect to each other by performing a process, e.g. a locking ring process.

Figure 7:
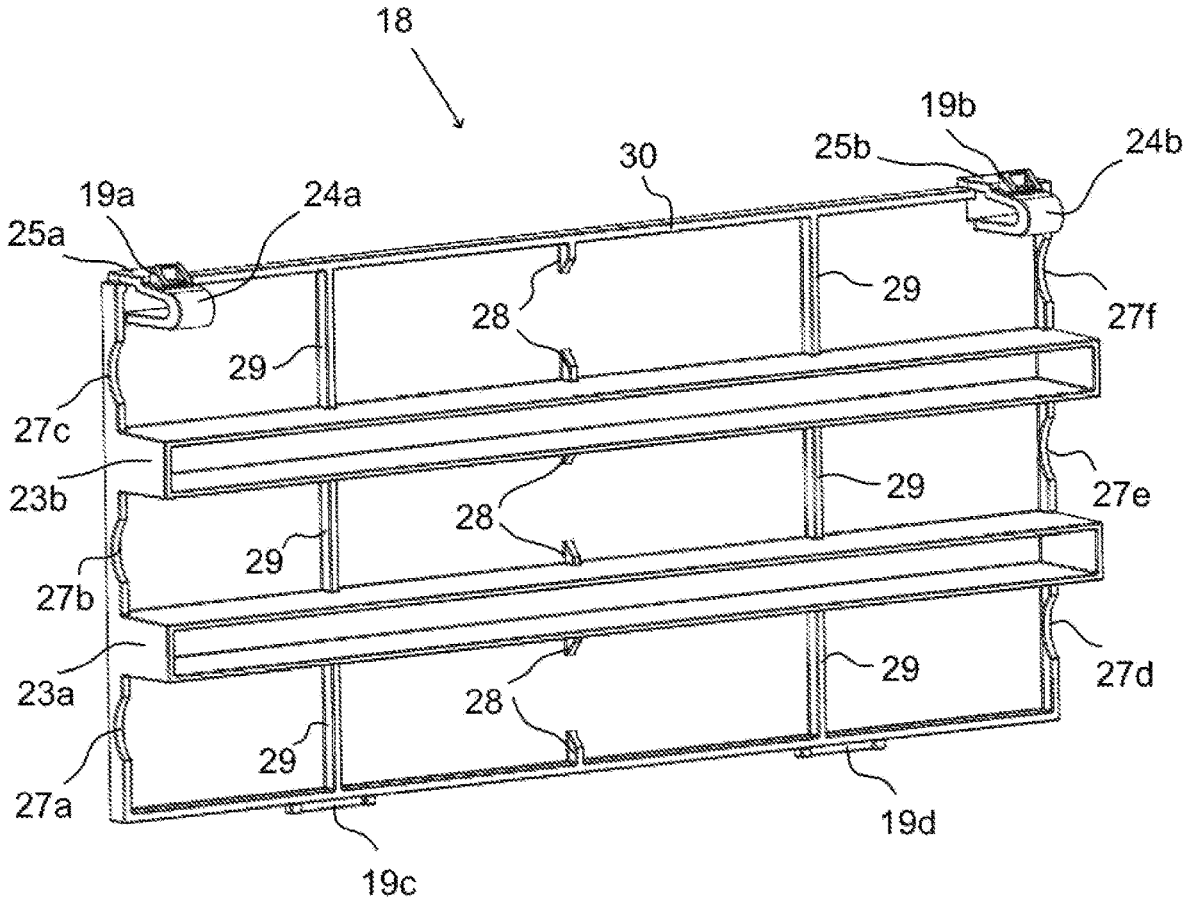
FIG. 7 is a perspective view of the cover element.
Figure 8:
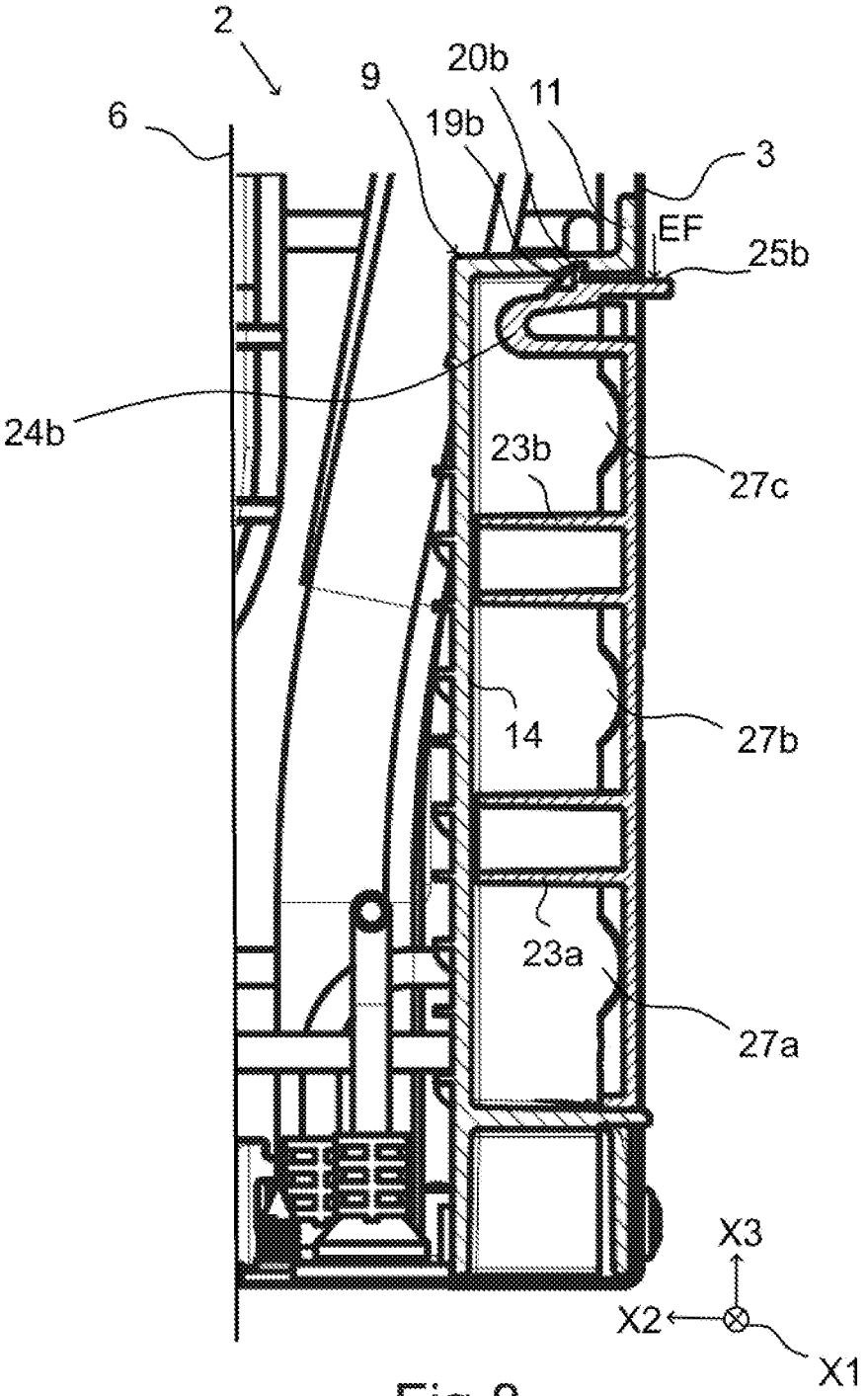
FIG. 8 is a fragmentary, cross-sectional view of a portion of the body where the component housing and the cover element are provided.

In a possible embodiment of the invention, as shown in FIGS. 3 and 4, the external cover element 18 is provided so as to be attached to the component housing 9 in a detachable manner. The cover element 18 is provided for selectively covering the access opening 10. The cover element 18 has a flat surface facing outside. Since the outer wall 3 also has a flat surface, such an arrangement does not adversely affect the outer appearance of the household appliance 1. As can be seen in FIGS. 6, 7 and 8, one or more attachment devices 19*a*-19*d* are provided on the cover element 18 so as to be attached to corresponding attachment grooves 20*a*-20*d* of the component housing 9. Preferably, the cover element 18 includes four attachment devices 19*a*-19*d*. Two of the attachment devices are provided at the upper side of the cover element 18: the first upper attachment device 19*a* and the second upper attachment device 19*b*. Two of the attachment devices are provided at the lower side of the cover element 18. These attachment devices are: the first lower attachment device 19*c* and the second lower attachment device 19*d*. The lower attachment devices 19*c*, 19*d* are configured as protrusions extending vertically. On the other hand, correspondingly, the component housing 9 includes four attachment grooves 20*a*-20*d* seen in FIGS. 5 and 6. In more detail, two of the attachment grooves are provided on a ceiling 21 of the component housing 9 provided at the upper side of the component housing 9. These attachment grooves are: the first upper attachment groove 20*a* and the second upper attachment groove 20*b*. The upper attachment grooves 20*a*, 20*b* are provided on opposite sides of the ceiling 21. In a possible embodiment, each of the upper attachment devices 19*a*, 19*b* has a flexible arm 24*a*, 24*b* defining a detaching surface 25*a*, 25*b* for detaching the respective upper attachment devices 19*a*, 19*b* from the corresponding upper attachment grooves 20*a*, 20*b* by applying an external force EF. On the other hand, two of the attachment grooves are provided on a base 22 of the component housing 9 provided at the lower side of the component housing 9. These attachment grooves are: the first lower attachment groove 20*c* and the second lower attachment groove 20*d*. The lower attachment grooves 20*c*, 20*d* are provided on opposite sides of the base 22.

The attaching process of the cover element 18 to the component housing 9 is as follows:

Firstly, the lower side of the cover element 18 is positioned so that the cover element 18 partially covers the access opening 10 at a first position. Here, the first position means that the cover element 18 is at an angled position with respect to the outer wall 3. In more detail, at the first position, the first lower attachment device 19*c* attaches to the first lower attachment groove 20*c*, and simultaneously the second lower attachment device 19*d* attaches to the second lower attachment groove 20*d*. Secondly, the cover element 18 is pivoted towards the access opening 10. Thirdly, when the cover element 18 completely covers the access opening 10 at a second position, the first flexible arm 24*a* flexes and the first upper attachment device 19*a* attaches to the first upper attachment groove 20*a* and simultaneously the second flexible arm 24*b* flexes and the second upper attachment device 19*b* attaches to the second upper attachment groove 20*b*, as seen in FIG. 8. When each of the upper attachment devices 19*a*, 19*b* are attached to the respective upper attachment grooves 20*a*, 20*b*, one or more support devices 23*a*, 23*b* provided on an inner surface of the cover element 18 facing the component housing 9, abut the rear wall of the component housing 14, as seen in FIG. 8. Thus, the rear wall of the component housing 14 is being supported against the pressure of the insulation material of the body 2 during the filling process of the insulation material. As can be seen in FIG. 8, the support devices 23*a*, 23*b* extend in the width direction X2. The support devices 23*a*, 23*b* also extend on the inner surface of the cover element 18 in the length direction X1 longitudinally. Preferably, there are two support devices: a first support device 23*a* and a second support device 23*b*. The support devices 23*a*, 23*b* are provided so as to be spaced apart from each other. Each of the support devices 23*a*, 23*b* has a hollow-shaped rectangular cross-section. On the other hand, there is a circumferential protrusion 30 provided circumferentially on the inner surface of the cover element 18. At least one reinforcement rib 28 is provided on the inner surface of the cover element 18 so as to support the reinforcement ribs 28 and the circumferential protrusion 30. Preferably, at least two of the reinforcement ribs 28 are provided for supporting the circumferential protrusion 30. Also one or more reinforcement protrusions 29 are provided on the inner surface of the cover element 18 so as to extend in the height direction X3 for supporting the reinforcement ribs 28 and the circumferential protrusion 30. On the other hand, with reference to FIGS. 7 and 8, a plurality of grooves 27*a*-27*f* are disposed on the circumferential protrusion 30 so as to correspond to the sealing members 17*a*-17*f*. In more detail, the first groove 27*a* corresponds to the first sealing member 17*a*, the second groove 27*b* corresponds to the second sealing member 17*b*, the third groove 27*c* corresponds to the third sealing member 17*c*, the fourth groove 27*d* corresponds to the fourth sealing member 17*d*, the fifth groove 27*e* corresponds to the fifth sealing member 17*e*, and the sixth groove 27*f* corresponds to the sixth sealing member 17*f*. Thus, the sealing members 17*a*-17*f* do not obstruct attachment of the cover element 18 to the component housing 9 and in this way, the cover element 18 can easily be attached to the component housing 9.

The detaching process of the cover element 18 from the component housing 9 is as follows:

Firstly, when the external force EF is applied to the respective flexible arms 24*a*, 24*b* as seen in FIG. 8 at the second position of the cover element 18, the flexible arms 24*a*, 24*b* flex. In more details, the external force EF can be applied to the first detaching surface 25*a* and the second detaching surface 25*b*. After that, the first upper attachment devices 19*a* detach from the first upper attachment groove 20*a*, and similarly the second upper attachment devices 19*b* detach from the second upper attachment groove 20*b*. Secondly, when the respective upper attachment devices 19*a*, 19*b* detached from the respective upper attachment grooves 20*a*, 20*b*, the cover element 18 transitions from the second position to the first position. In more details, the cover element 18 pivots towards outside. Thirdly, when the cover element 18 is pulled towards outside, the first lower attachment devices 19*c* detach from the first lower attachment groove 20*c*, and simultaneously the second lower attachment devices 19*d* detach from the second lower attachment groove 20*d*. In this way, the cover element 18 can easily be separated from the component housing 9.

Figure 9:
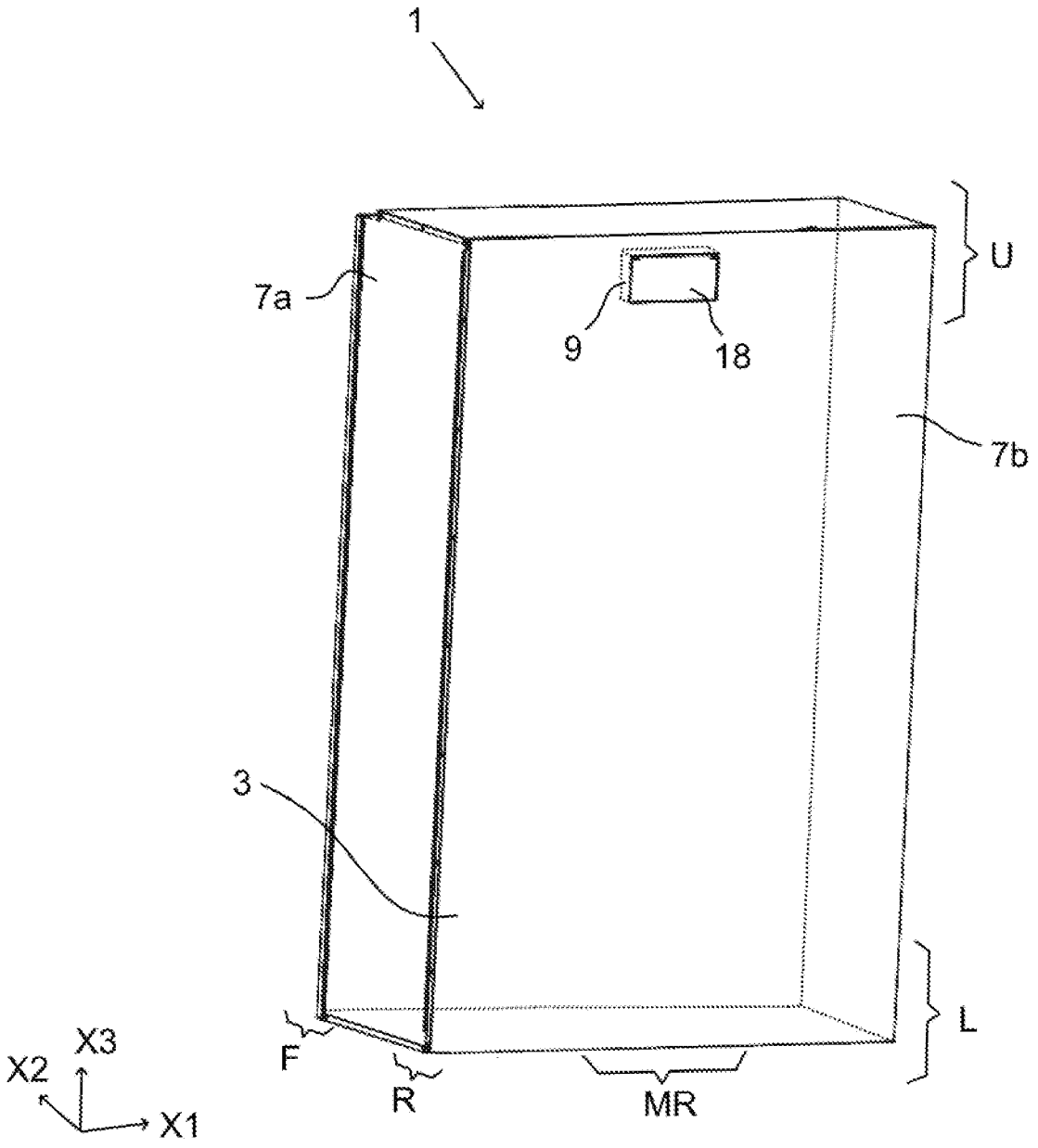
FIG. 9 is a perspective view of the exemplary household appliance from the rear side where the component housing and the cover element are provided at the upper side of the body.

As can be seen in FIG. 3, the component housing 9 and the cover element 18 can be located at the lower side L of the household appliance 1, or with reference to FIG. 9, the component housing 9 and the cover element 18 can be located at the upper side U of the household appliance 1.

The following is a summary list of reference numerals and the corresponding structure used in the above description of the invention.

REFERENCE LIST

1. Household appliance
2. Body
3. Outer wall
4. Access cutout
5*a*. First door
5*b*. Second door
6. Inner wall
7*a*. First sidewall of the body
7*b*. Second sidewall of the body
8*a*. First system component
8*b*. Second system component
8*c*. Third system component
8*d*. Fourth system component
8*e*. Fifth system component
8*f*. Sixth system component
9. Component housing
10. Access opening
11. Connection frame
12. Connection holes of the connection frame
13*a*. First system component fixation device
13*b*. Second system component fixation device
13*c*. Third system component fixation device
13*d*. Fourth system component fixation device
13*e*. Fifth system component fixation device
13*f*. Sixth system component fixation device
14. Rear wall of the component housing
15*a*. First cutout
15*b*. Second cutout
15*c*. Third cutout
15*d*. Fourth cutout
15*e*. Fifth cutout
15*f*. Sixth cutout
16*a*. First sidewall
16*b*. Second sidewall
17*a*. First sealing member
17*b*. Second sealing member
17*c*. Third sealing member
17*d*. Fourth sealing member
17*e*. Fifth sealing member
17*f*. Sixth sealing member
18. Cover element
19*a*. First upper attachment device
19*b*. Second upper attachment device
19*c*. First lower attachment device
19*d*. Second lower attachment device
20*a*. First upper attachment groove
20*b*. Second upper attachment groove
20*c*. First lower attachment groove
20*d*. Second lower attachment groove
21. Ceiling
22. Base
23*a*. First support device
23*b*. Second support device
24*a*. First flexible arm
24*b*. Second flexible arm
25*a*. First detaching surface
25*b*. Second detaching surface
26. Connection holes of the outer wall
27*a*. First groove
27*b*. Second groove
27*c*. Third groove
27*d*. Fourth groove
27*e*. Fifth groove
27*f*. Sixth groove
28. Reinforcement ribs
29. Reinforcement protrusions
30. Circumferential protrusion
F. Front side
R. Rear side
U. Upper side
L. lower side
MR. Middle region
EF. External force
X1. Length direction
X2. Width direction
X3. Height direction

The invention claimed is:

1. A household appliance or cooling appliance, comprising:

a body having an outer wall facing outside of the appliance, and an inner wall spaced apart from said outer wall;

at least one system component located between said outer and inner walls, said at least one system component being at least one conduit or pipe through which a fluid passes, and each said at least one system component having a substantially circular cross section;

an external component housing disposed inside said body, said external component housing having an access opening for reaching at least a portion of said at least one system component from outside of the appliance;

said external component housing having a rear wall disposed opposite to said access opening, said external component housing having at least one system component fixation device for respectively fixing said at least one system component on said rear wall of said component housing;

each said at least one system component fixation device being shaped and sized relative to said at least one system component to respectively at least partially encircle said at least one system component in a tight-fit manner; and said at least one system component fixation device having receiving sections being substantially C-shaped.

2. The household appliance according to claim 1, wherein said component housing is a box-shaped structure.

3. The household appliance according to claim 1, wherein said outer wall has an access cutout formed therein corresponding to said access opening.

4. The household appliance according to claim 3, wherein said component housing includes a connection frame being substantially parallel to said outer wall.

5. The household appliance according to claim 4, wherein said connection frame has at least one connection hole formed therein for connecting said component housing to said outer wall.

6. A household appliance or cooling appliance, comprising:

a body having an outer wall facing outside of the appliance, and an inner wall spaced apart from said outer wall;

at least one system component located between said outer and inner walls, said at least one system component being at least one conduit or pipe through which a fluid passes;

an external component housing disposed inside said body, said external component housing having an access opening for reaching at least a portion of said at least one system component from outside of the appliance;

said external component housing having a rear wall disposed opposite to said access opening, and said external component housing having at least one system component fixation device for respectively fixing said at least one system component on said rear wall of said component housing;

each said at least one system component fixation device being shaped and sized relative to said at least one system component to respectively at least partially encircle said at least one system component in a tight-fit manner;

said external component housing having sidewalls with at least one cutout formed therein for permitting said at least one conduit or pipe to enter inside said component housing; and at least one sealing member is respectively provided in said at least one cutout and respectively surrounding said at least one cutout.

7. The household appliance according to claim 1, which further comprises an external cover element configured to be attached to and detached from said component housing for selectively covering said access opening.

8. The household appliance according to claim 7, which further comprises at least one attachment device disposed on said cover element and configured to be attached at least at one corresponding attachment groove formed in said component housing.

9. The household appliance according to claim 8, wherein said component housing has a rear wall, and said cover element has at least one support device abutting said rear wall of said component housing when said cover element is attached to said component housing.

10. The household appliance according to claim 1, wherein said at least one system component includes electrical system components or electrical cables.

11. The household appliance according to claim 1, which further comprises:

a front side of the household appliance at which at least one door is disposed; and a rear side of the household appliance at which said component housing is disposed, said rear side being disposed opposite to said front side.

12. The household appliance according to claim 1, wherein said body has mutually opposite sidewalls, a substantially middle region of the household appliance is disposed between said sidewalls, and said component housing is disposed at said middle region.

13. A household appliance or cooling appliance, comprising:

a body having an outer wall facing outside of the appliance, and an inner wall spaced apart from said outer wall;

at least one system component located between said outer and inner walls;

an external component housing disposed inside said body, said external component housing having an access opening for reaching at least a portion of said at least one system component from outside of the appliance;

an external cover element configured to be attached to and detached from said external component housing for selectively covering said access opening;

at least one attachment device disposed on said external cover element and configured to be attached at least at one corresponding attachment groove formed in said external component housing;

said at least one attachment groove including a plurality of attachment grooves; and said at least one attachment device including upper attachment devices each having a respective flexible arm defining a detaching surface for detaching said respective upper attachment devices from said upper attachment grooves by applying an external force.

14. The household appliance according to claim 13, wherein said component housing has a rear wall disposed opposite to said access opening, and said component housing has at least one system component fixation device for respectively fixing said at least one system component on said rear wall of said component housing.

15. The household appliance according to claim 14, wherein:

said at least one system component is at least one conduit or pipe through which a fluid passes; and each said at least one system component fixation device is shaped and sized relative to said at least one system component to respectively at least partially encircle said at least one system component in a tight-fit manner.

* * * * *